US006663255B1

(12) United States Patent
Carito

(10) Patent No.: US 6,663,255 B1
(45) Date of Patent: Dec. 16, 2003

(54) RE-USABLE SELF-ILLUMINATING SIGN

(76) Inventor: Domenic Carito, 129 Pleasant St., Wakefield, MA (US) 01880

( * ) Notice: Subject to any disclaimer, the term of this patent is extended or adjusted under 35 U.S.C. 154(b) by 0 days.

(21) Appl. No.: 10/166,555

(22) Filed: Jun. 10, 2002

(51) Int. Cl.[7] ..... F21K 2/00
(52) U.S. Cl. ..... 362/34; 362/812; 40/542
(58) Field of Search ..... 362/34, 84, 812; 40/539, 540, 542

(56) References Cited

U.S. PATENT DOCUMENTS 3,752,406 A * 8/1973 McDermott et al. ..... 362/34
5,326,265 A * 7/1994 Prevou ..... 434/11
5,406,463 A * 4/1995 Schexnayder, Sr. ..... 362/34
5,557,869 A * 9/1996 Douglas ..... 40/542
6,197,218 B1 * 3/2001 Hampden-Smith et al. ..... 252/301.4 R
2003/0046841 A1 * 3/2003 Arias ..... 40/542

* cited by examiner

*Primary Examiner*—Sandra O'Shea
*Assistant Examiner*—John Anthony Ward
(74) *Attorney, Agent, or Firm*—Mark P. White

(57) ABSTRACT

A re-usable, self-illuminating sign includes a translucent plastic photoluminescent display panel, disposed within a display body, the display panel formed by distributing a photoluminescent powder uniformly throughout the plastic. A chemiluminescent light stick serves as a light source for the sign, which is in the form of a cylinder with a triangular cross section. When the light stick is exhausted, it may be removed from the display body and replaced by a new light stick. The photoluminescent display panel receives the light from the light stick, and retransmits the light uniformly throughout the display panel. A mask disposed in front of the display panel contains cutouts providing the the text and/or graphics of the sign.

11 Claims, 3 Drawing Sheets

RE-USABLE SELF-ILLUMINATING SIGN

BACKGROUND OF INVENTION

The phenomenon of chemiluminescence has been known for some time. This phenomenon is the basis of a number of inventions, including novelty items such as light sticks, glow bracelets and necklaces, and light wands, which may be seen at concerts, theme parks, etc. during the early evening and nighttime hours. The usual method of operation of these items is to bend, shake, or otherwise cause an internal, frangible container to break, resulting in the mixing of chemicals which exhibits a chemiluminescence reaction. These items are very inexpensive, and are essentially "throw away" items, as they cannot be reused. The basis for such items is described in U.S. Pat. No. 3,584,211, which discloses the "light stick", in which a cylindrical container holds one chemical, and an internal, frangible, smaller cylindrical container contains a second chemical. When the cylinder is bent sufficiently, the internal container breaks, allowing the two chemicals to mix, causing the desired reaction. These novelty glow products typically continue to produce light for between 6 and 10 hours after being activated.

Chemiluminescence is used for more serious applications as well. These include safety applications under conditions where power sources, such as batteries, are not appropriate. For instance, divers use items similar to glow sticks to make them visible during night dives.

The present invention combines the light-producing qualities of chemiluminescent devices with the light-retaining qualities of photoluminescent materials. U.S. Pat. Nos. 4,992,302, and 6,008,012 describe methods for making photoluminescent powders, which can be incorporated in other materials, such as plastics, making the plastics themselves photoluminescent. Such materials may continue to glow for up to 10 hours after being exposed to light.

In the present invention chemiluminescent light sticks are combined with photoluminescent plastic to produce illuminated signs which are inexpensive, reusable, and do not require external power sources. As such, they are useful as toys, novelties, and safety devices.

SUMMARY OF INVENTION

It is an object of the present invention to provide a which contains its own source of illumination, and which is simple and inexpensive to build.

It is a further object of this invention that such a sign be re-usable.

In accordance with one aspect of the present invention, the source of the light is a chemiluminescent light stick.

In accordance with a second aspect of the invention, the light contains a display panel which is impregnated with photoluminescent powder.

In accordance with a third aspect of the invention the display panel has a mask on its face with cutouts through which the light created by the photoluminescent powder may be seen.

In accordance with a fourth aspect of the invention the display panel is part of a cylindrical body with triangular cross section.

In accordance with a fifth aspect of the invention the light stick fits snugly within the body, and is retained therein by friction.

In accordance with a sixth aspect of the invention the mask is formed on the display panel by stamping.

In accordance with an eighth aspect of the invention the mask is formed on the display panel by screening.

In accordance with a final aspect of the invention the body is formed from a single sheet of material impregnated with the photoluminescent powder, which contains tabs and slots to hold the body together when assembled.

BRIEF DESCRIPTION OF DRAWINGS

These, and further features of the invention, may be better understood with reference to the accompanying specification and drawings depicting the preferred embodiment, in which.

DETAILED DESCRIPTION

The present invention, in its preferred embodiment utilizes a light stick as a source of light, together with a plastic sheet impregnated with a photoluminescent powder, which stores and retransmits the light of the glow stick distributed over the surface of the sheet. The sheet thus becomes a photoluminescent surface. A mask covering the photoluminescent surface has cut-out portions so that the effect produced is that of an illuminated sign.

The light stick is of the type described in U.S. Pat. No. 3,584,211, wherein two chemicals are combined when the light stick is bent sufficiently to fracture a frangible container holding one of the chemicals, the resulting chemical reaction producing light by the well-known chemiluminescence.

The typical light stick is between 4 and 6 inches in length. There is no inherent limit to the length of the glow stick, and extended forms, including wands and necklaces are commonly available. However, the increase in diameter beyond about ½ inch becomes impractical because the amount of chemical involved becomes economically unfeasible. The inclusion of the photoluminescent surface in the present invention allows the illuminating effect of the light stick to be spread substantially uniformly over a surface are much larger than that of the light stick, producing a glowing sign several inches in width.

Figure 1:
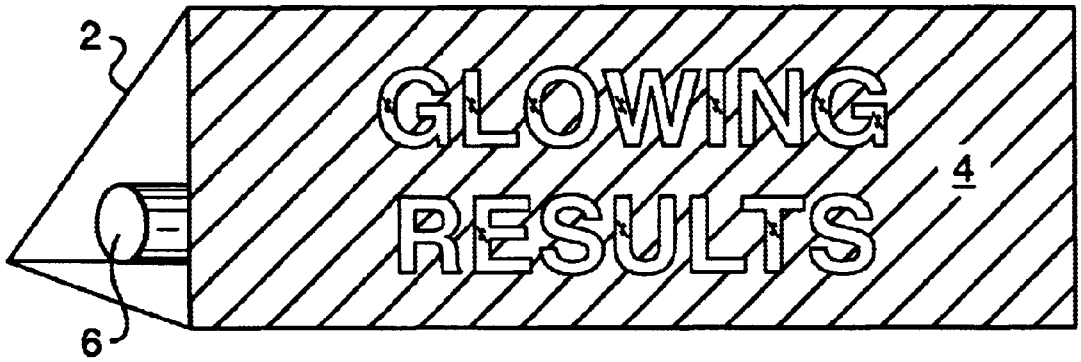
FIG. 1 depicts a perspective view of the sign.
Figure 2:
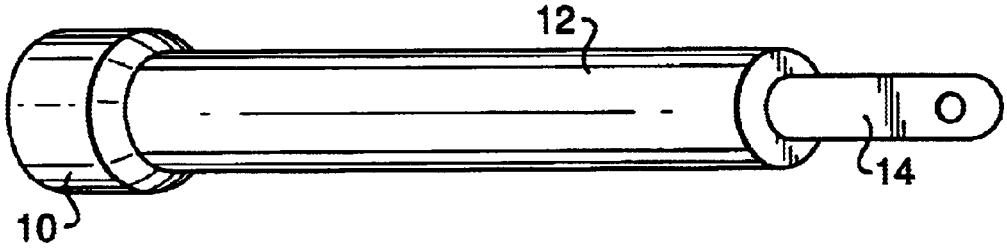
FIG. 2 depicts a perspective view of a light stick used as the source of illumination in the sign.

A sign in accordance with the preferred embodiment of the invention is shown in FIG. 1. The body 2 of the sign has a triangular cross section, and is formed of a soft, translucent plastic material. The glow stick 6 has a diameter of ½ inch, and is 4 inches in length. The glow stick is shown in FIG. 2, and has a body 12 which is ½ inch in diameter, and a cap 10 about 3/16 inch larger in diameter than the body. A suspension tab 14 is commonly found in such light sticks, but serves no purpose in the present invention.

The dimensions of the triangular sign body are such that the glow stick is snugly retained by friction. Thus the glow stick (also called a light stick), which is not reusable, may be replaced when the life of the chemiluminescent reaction expires.

The sign display surface 4 has a mask with the words "GLOWING RESULTS" cut out, so that the light of the photoluminescent surface shows through.

Figure 3:
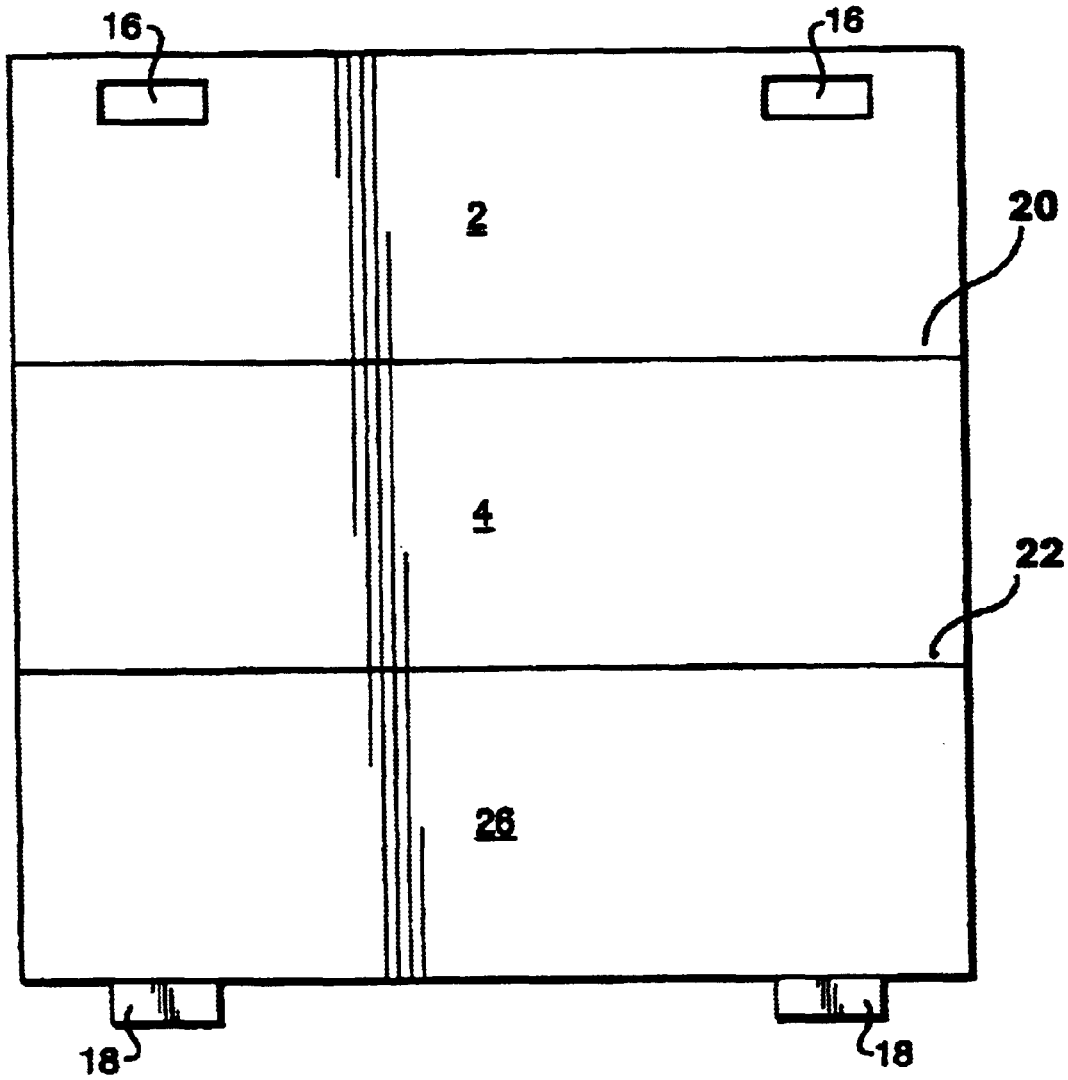
FIG. 3 depicts a sheet of material cut to shape, and with bend lines, tabs and slots which can be folded into the shape of the sign.

The sign body is formed from a single sheet of material in the preferred embodiment, as shown in FIG. 3. The body is separated into thirds by the upper fold line 20 and the lower fold line 22. The 2 display panel 4 is adjacent to the upper body 2 and the lower body 26. Two tabs 18 in the lower body mate with slots 16 in the upper body, so that the body, when folded along the fold lines, retains the body in the form of a cylinder with triangular cross section. Friction may be used to keep the tabs within the slots, or adhesive, or heat bonding may be used as alternatives.

In an alternative embodiment the sign body and display are extruded or molded in a single piece. In a still further embodiment, the display panel is formed separately from the body, which need not be impregnated with the photoluminescent powder, although the display panel is so impregnated.

Although only the surface 2 need be photoluminescent, it has been found that making the entire sheet of FIG. 3 photoluminescent simplifies the manufacturing process.

The mask may be applied by a number of different methods, including screening, stamping, etc.

A typical sign made in accordance with this invention is about four to six inches in length, and two inches in width. There is no inherent limit to the length of the sign, however, and light wands are available in lengths up to several feet.

While the invention has been described with reference to specific embodiments, it will be apparent that improvements and modifications may be made within the purview of the invention without departing from the scope of the invention defined in the appended claims.

What is claimed is:

1. A self-illuminating sign comprising;

(a) a display panel in the form of a cylinder with a triangular cross-section comprised of either a transparent or a translucent material which further comprises a photoluminescent powder substantially uniformly distributed throughout said display panel;

(b) a mask, disposed in front of the display panel, the mask having a graphic formed within by means of substantially opaque portions and substantially transparent portions; and (c) one or more light sticks, disposed within the display panel, so that when the chemicals within the light stick mix, the luminous energy emitted by the light stick is absorbed by the photoluminescent powder, is retransmitted as light substantially uniformly distributed throughout the display panel, and is seen through the substantially transparent portion of the mask.

2. The signs of claim 1, wherein the display panel material further comprises plastic.

3. The sign of claim 2, wherein the display panel is integrally formed as part of a rectangular sheet, the sheet further comprising two fold lines which divide the sheet into a top body part, the display panel, and a bottom body part, the bottom body part containig one or more tabs, and the top body part containing one or more slots which mate with the tabs, so that when the sheet is folded along the fold lines the tabs mate with the slots, and a body having the form of a cylinder with a triangular cross section is formed.

4. The sign of claim 2, wherein the display panel and a sign body are integrally formed in a cylindrical shape with a triangular cross section by a method which comprises a member of the list which consists of extrusion and molding.

5. The sign of claim 2, wherein the display panel is formed separately from a sign body, the body being formed from a sheet folded into two parts, the body and display panel forming a cylinder with a triangular cross section when attached.

6. The sign of claim 3, wherein the light stick has a major axis, and is removeably inserted with its major axis parallel to a major axis of the body.

7. The sign of claim 4, wherein the light stick has a major axis, and is removeably inserted with its major axis parallel to a major axis of the body.

8. The sign of claim 5, wherein the light stick has a major axis, and is removeably inserted with its major axis parallel to a major axis of the body.

9. The sign of claim 6, where the mask is affixed to the display body by means which is selected from the group which consists of screening, stamping, printing and painting.

10. The sign of claim 7, where the mask is affixed to the display body by means which is selected from the group which consists of screening, stamping, printing and painting.

11. The sign of claim 8, where the mask is affixed to the display body by means which is selected from the group which consists of screening, stamping, printing and painting.

* * * * *